US010403999B2

(12) United States Patent
Nishida et al.

(10) Patent No.: US 10,403,999 B2
(45) Date of Patent: Sep. 3, 2019

(54) TERMINAL FITTING, AND CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Shiro Nishida, Mie (JP); Seido Nishijima, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/064,015

(22) PCT Filed: Dec. 7, 2016

(86) PCT No.: PCT/JP2016/086316
§ 371 (c)(1),
(2) Date: Jun. 20, 2018

(87) PCT Pub. No.: WO2017/110466
PCT Pub. Date: Jun. 29, 2017

(65) Prior Publication Data

US 2018/0375242 A1 Dec. 27, 2018

(30) Foreign Application Priority Data

Dec. 24, 2015 (JP) ..... 2015-251242

(51) Int. Cl.
*H01H 1/24* (2006.01)
*H01R 11/12* (2006.01)
(Continued)

(52) U.S. Cl.
CPC ..... *H01R 13/187* (2013.01); *H01H 1/24* (2013.01); *H01R 11/12* (2013.01); *H01R 13/24* (2013.01);
(Continued)

(58) Field of Classification Search
CPC .... H01R 13/187; H01R 13/33; H01R 4/4863; H01R 13/2421; H01R 13/24; H01R 13/533; H01R 1/24; H01R 11/12
(Continued)

(56) References Cited

U.S. PATENT DOCUMENTS 4,093,337 A 6/1978 Jacobson
4,462,657 A * 7/1984 Snowdon ..... H01R 13/187 439/724

(Continued)

FOREIGN PATENT DOCUMENTS

| | | |
|---|---|---|
| DE | 1 137 783 | 10/1962 |
| JP | 52-70386 | 6/1977 |
| JP | 3-11821 | 3/1991 |
| JP | 2002-274290 | 9/2002 |

OTHER PUBLICATIONS

International Search Report dated Jan. 10, 2017.

*Primary Examiner* — Gary F Paumen
(74) *Attorney, Agent, or Firm* — Gerald E. Hespos; Michael J. Porco; Matthew T. Hespos

(57) ABSTRACT

A terminal fitting (10) includes an electrical contact (20) with a facing surface (21) facing a contact surface (81) of a mating terminal (80). A canted coil spring (50) that is made of a conductive wire material (51) has a wound surface inclined with respect to the coil axis (L) of the canted coil spring (60). The coil axis (L) is parallel with the facing surface (21) of the electrical contact member (20). The canted coil spring (50) is sandwiched between the mating terminal (80) and the electrical contact member (20) when
(Continued)

the mating terminal (80) and the electrical contact member (20) approach each other. A holder shaft (40) is inserted in the canted coil spring (50) to hold the canted coil spring (50) in a posture where the coil axis L is parallel with the facing surface (21) of the electrical contact member (20).

7 Claims, 6 Drawing Sheets

(51) Int. Cl.
*H01R 13/24* (2006.01)
*H01R 13/33* (2006.01)
*H01R 13/187* (2006.01)
*H01R 13/533* (2006.01)

(52) U.S. Cl.
CPC ..... *H01R 13/2421* (2013.01); *H01R 13/33* (2013.01); *H01R 13/533* (2013.01)

(58) Field of Classification Search
USPC ..... 439/840, 841
See application file for complete search history.

(56) References Cited

U.S. PATENT DOCUMENTS 4,810,213 A * 3/1989 Chabot ..... H01R 13/17 439/825
6,439,894 B1 * 8/2002 Li ..... H01R 13/2407 439/66
8,096,842 B2 * 1/2012 Poon ..... H01L 31/0508 439/65
8,529,303 B2 * 9/2013 Zhang ..... H01H 1/06 439/840
8,735,751 B2 * 5/2014 Rust ..... H01R 13/187 200/276
2003/0157846 A1 * 8/2003 Poon ..... H01R 13/187 439/840
2010/0304623 A1 * 12/2010 Poon ..... H01L 31/0508 439/840
2011/0124245 A1 * 5/2011 Fujita ..... H01R 13/17 439/840
2012/0273332 A1 * 11/2012 Rust ..... H01R 13/187 200/276

* cited by examiner

TERMINAL FITTING, AND CONNECTOR

BACKGROUND

Field of the Invention

This description relates to a terminal fitting and to a connector accommodating the terminal fitting.

Description of the Related Art

A known method for providing electrical connection in an automobile or the like involves pushing facing junctions against each other for bringing them into contact with each other. In such a method, established continuity is poor in the case where contamination exists between junctions. For this reason, in Japanese Patent Laid-Open No. 2002-274290, the two junctions are rubbed together when they are pushed against each other to enable removal of any contamination therebetween.

To be specific, in the power-feeding device in Japanese Patent Laid-Open No. 2002-274290, the female junction has sole plates facing each other, and a coil spring held and compressed between these sole plates in a case. The sole plate exposed to the exterior has an elastic leaf spring. This leaf spring has a sloped free end portion that is bent after being extended out of the sole plate toward the exterior and is therefore easily elastically deformable. The two junctions are rubbed together when a male junction and the female junction (free end portion) come in contact with each other, thereby removing any contamination therebetween.

The configuration disclosed in Japanese Patent Laid-Open No. 2002-274290 is not available with large current. This is because, the thickness of the leaf spring should be large for use with large current, and the thicker leaf spring has an increased stiffness so that the bent portion is hardly elastically deformable. Hence, upon contact with the male junction, the free end portion of the leaf spring member barely is subjected to a shifted movement phenomenon caused by elastic deformation, resulting in inadequate removal of contamination on the contact portion.

SUMMARY

A terminal fitting disclosed in this description includes: an electrical contact member that has an facing surface configured to face a contact surface provided on a mating terminal. The electrical contact member is configured to be connected to an external circuit. The terminal fitting further has a canted coil spring that is in the shape of a coil of multiple turns of a conductive wire material. The coil has a wound surface inclined with respect to the coil axis of the canted coil spring. The coil axis being is parallel with the facing surface of the electrical contact member. The canted coil spring is configured to be sandwiched between the mating terminal and the electrical contact member when the mating terminal and the electrical contact member approach each other. The electrical contact member has a holder shaft that is inserted in the canted coil spring to hold the canted coil spring in a posture where the coil axis is parallel with the facing surface of the electrical contact member.

The canted coil spring is fixed to the electrical contact member through the holder shaft. Additionally, the coil axis is parallel with the facing surface of the electrical contact member and the wound surface is inclined with respect to the coil axis. Accordingly, when the mating terminal and the electrical contact member approach each other, the canted coil spring is sandwiched between the contact surface of the mating terminal and the facing surface of the electrical contact member. As a result, the mating terminal and the electrical contact member are connected electrically to each other.

In this connection state, when the mating terminal and the electrical contact member move to approach each other, the canted coil spring resists its elasticity and deforms in such a manner that the wound surface inclines farther. Through this process, in a contact portion between the canted coil spring and the contact surface of the mating terminal and a contact portion between the canted coil spring and the facing surface of the electrical contact member, a shifted movement phenomenon occurs in such a manner that the canted coil spring rubs each surface. Therefore, even if the surfaces have contamination, the contamination is rubbed off.

The electrical contact member may include two fixed segments facing each other and standing from respective end portions of the facing surface, and both end portions of the holder shaft may be fixed to the fixed segments. This configuration allows the canted coil spring to be fixed with a simple structure without dropping out of the shaft member.

An embodiment of a connector using a terminal fitting disclosed in this description may include a connector housing that can accommodate a terminal fitting. The connector housing may have an opening through which the mating terminal is capable of entering into the connector housing and coming in contact with the canted coil spring. This configuration allows the terminal fitting to be protected by the connector housing while allowing the mating terminal to enter through the opening for connection.

A terminal fitting disclosed in this description enables removal of contamination between the terminal fitting and a mating terminal.

DETAILED DESCRIPTION

An embodiment will be described with reference to FIGS. 1 to 6.

Figure 1:
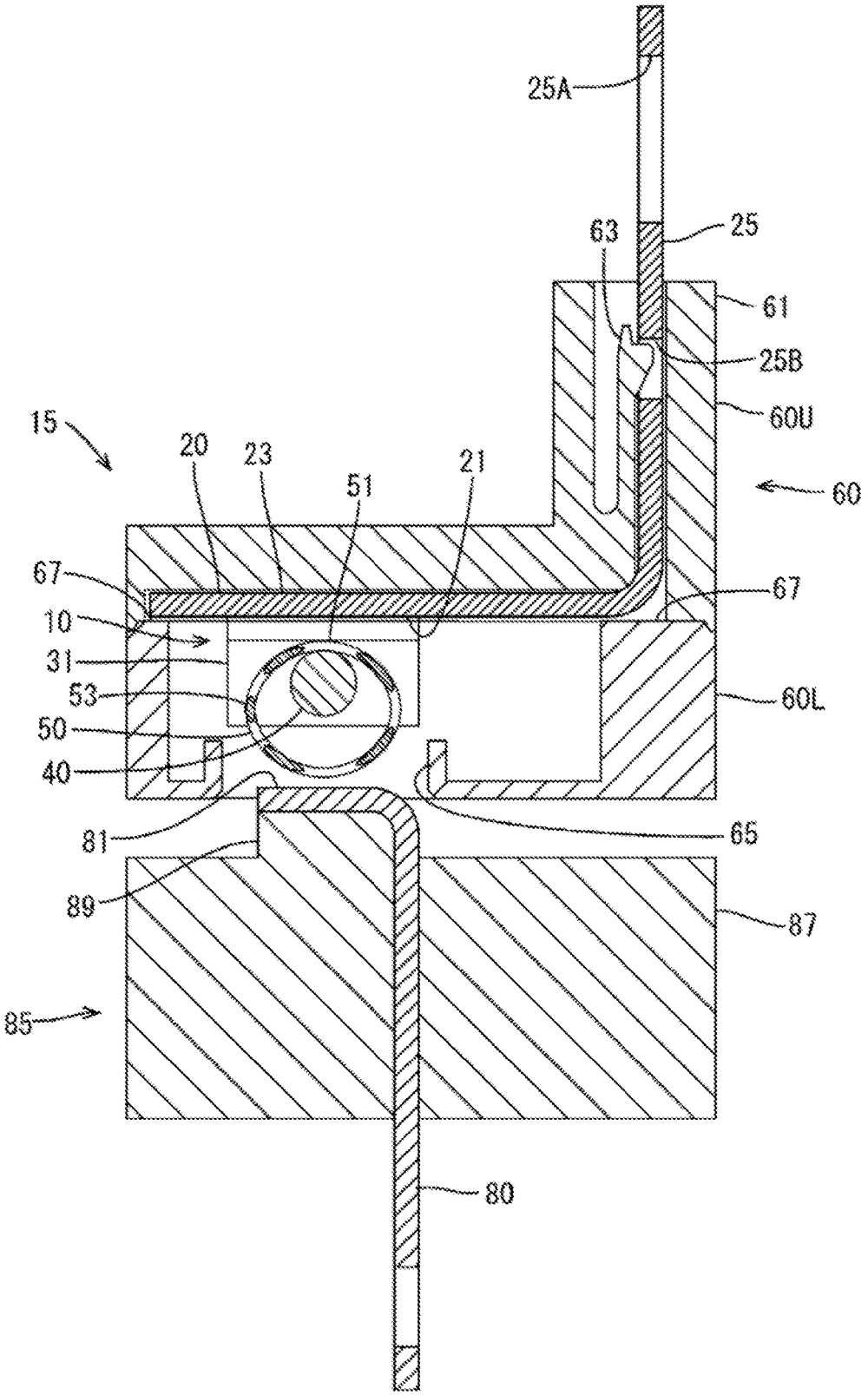
FIG. 1 is a sectional view showing the state before engagement between a connector and a mating connector according to an embodiment.

A terminal fitting 10 of this embodiment is electrically connected to a mating terminal 80 when pushed against the mating terminal 80. The terminal fitting 10 is contained in a connector housing 60, and a connector 15 includes the terminal fitting 10 and the connector housing 60. The terminal fitting 10 includes an electrical contact member 20, a holder shaft 40, and a canted coil spring 50. The upper side in FIG. 1 is referred to herein as an upper side, and the lower side in FIG. 1 (the mating terminal 80 side) is referred to herein as a lower side. Further, the left side in FIG. 1 is referred to herein as the front, and the right side in FIG. 1 (an external connection portion 25 side) is referred to as the back. The left-right direction (width direction) will be made by reference to FIG. 2.

Figure 2:
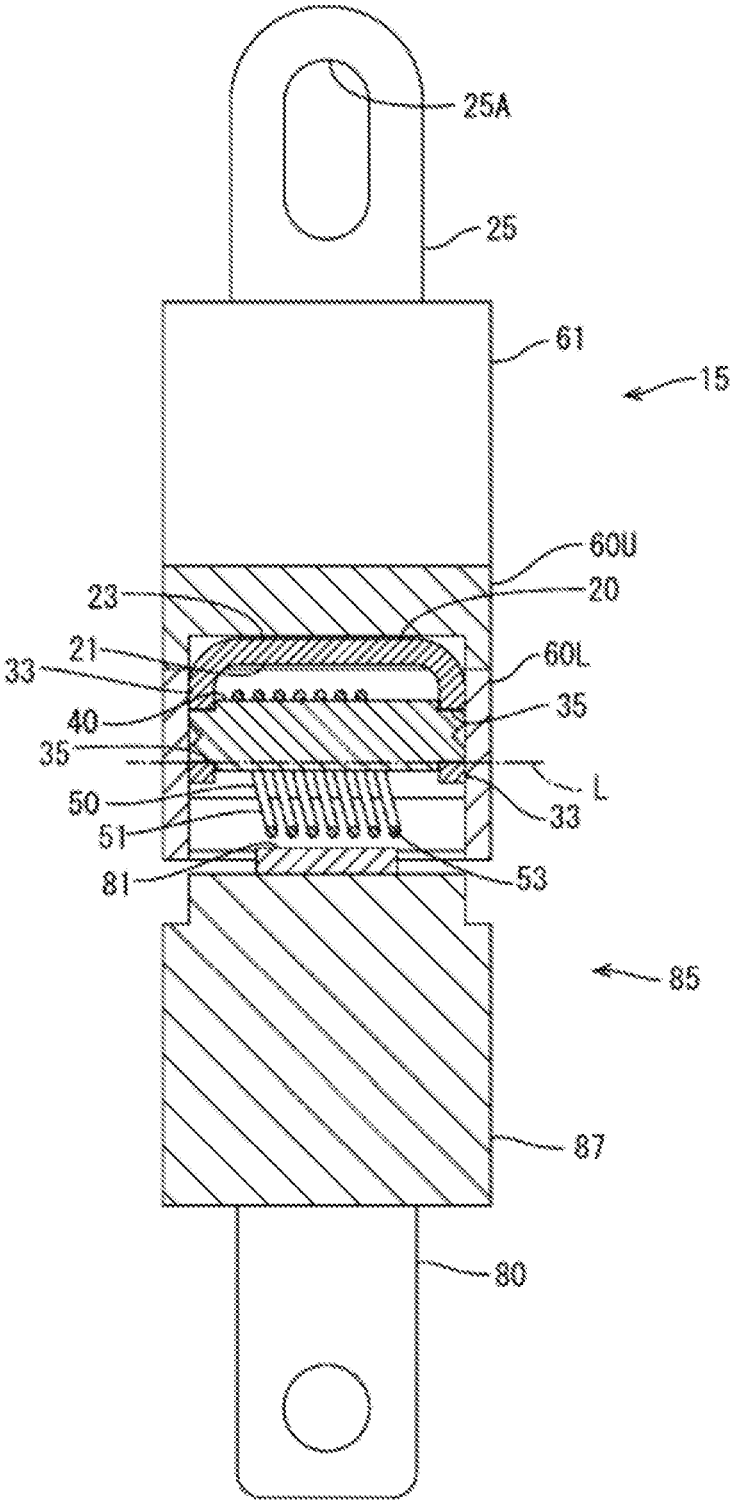
FIG. 2 is a cross-sectional view showing the state before engagement between the connector and the mating connector.

As shown in FIGS. 1 and 2, the electrical contact member 20 is obtained by stamping a metal plate of a copper alloy or the like and is in a substantially L shape. The electrical contact member 20 includes a reception portion 23 having a facing surface 21 to come in contact with the canted coil spring 50. An external connection portion 25 stands up at right angles to the facing surface 21 and is configured to be connected to an external circuit. Two fixed segments 31 face each other and stand from respective end portions of the facing surface 21. The external connection portion 25 has a bolt hole 25A, which is a long hole, and a latch hole 25B to be engaged with the connector housing 60.

The reception portion 23 is a fixed-width flat plate configured so that the left-right dimension (width) exceeds the length of the canted coil spring 50 in the axial direction (front-back direction). The reception portion 23 has a lower surface serving as the facing surface 21. The fixed segments 31 are substantially rectangular and are bent at both ends of the reception portion 23 in the width direction at substantially right angles. Thus, the fixed segments 31 face each other and stand from respective end portions of the facing surface 21. A fixed hole 33 penetrates in the plate thickness direction through a substantially central portion of each fixed segment 31.

Figure 4:
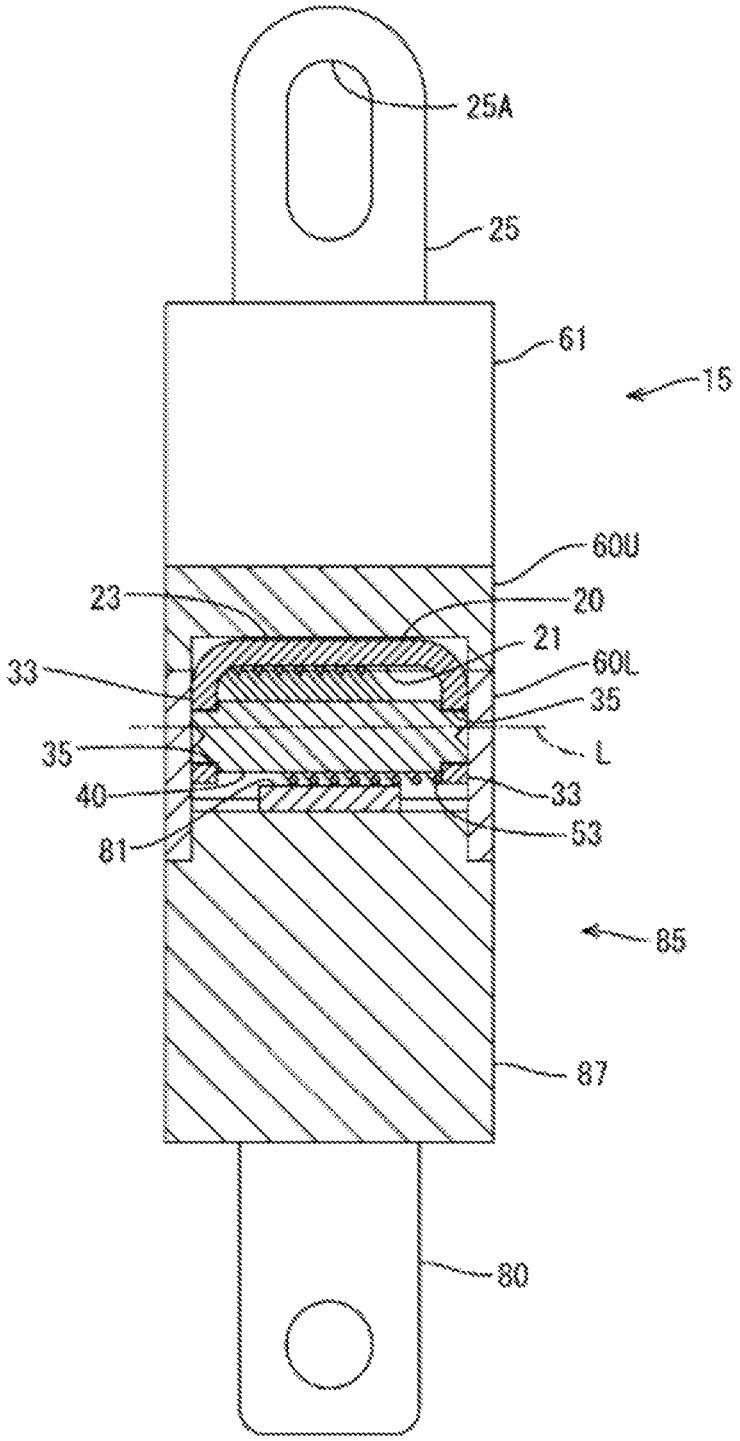
FIG. 4 is a cross-sectional view showing the state before complete engagement between the connector and the mating connector.

As shown in FIGS. 1 and 2, the holder shaft 40 is a brass round bar disposed in such a manner that its center axis is parallel with the facing surface 21 of the electrical contact member 20. The holder shaft 40 is passed through the fixed hole 33 and fixed to the fixed segments 31 with its end portions swaged. The diameter of the holder shaft 40 is smaller than the inner diameter along the minor axis of the canted coil spring 50 deformed during engagement. As shown in FIG. 4, the holder shaft 40 is disposed in a position where it does not come in contact with the inner periphery of a lower part of the canted coil spring 50 in the state where the connector 15 and a mating connector 85 are completely engaged with each other.

As shown in FIGS. 1 and 2, the canted coil spring 50 has multiple turns of a conductive wire material 51. Unlike a typical coil spring, the canted coil spring 50 is wound in such a manner that the wound surface of each coil turn constituting the spring is inclined with respect to the coil axis L. Under a load on an outer region 53, the wound surface of each coil turn is tilted and is inclined farther toward the coil axis L, and the canted coil spring 50 deforms in such a manner that the height of the spring (the length in the direction perpendicular to the axial direction of the spring) is made small. The canted coil spring 50 has a non-linear region that is not subjected to a substantial change in spring load even if the amount of the displacement of the canted coil spring 50 (the amount of change in the height of the spring) is changed.

As shown in FIGS. 1 and 2, the canted coil spring 50 is disposed so that its coil axis L is substantially parallel with the facing surface 21. The holder shaft 40 is present in the canted coil spring 50, and this holder shaft 40 is fixed at both ends with the fixed segments 31, thereby preventing the canted coil spring 50 from dropping out of the holder shaft 40. The length of the canted coil spring 50 is smaller than that of the holder shaft 40. The canted coil spring 50 is in an ellipse shape when viewed from the winding direction and is disposed so that the minor axis of the ellipse is oriented in the up-and-down direction at least while being connected to the mating terminal 80.

As shown in FIG. 1, the connector housing 60 has an upper body 60U and a lower body 60L that are composed of a synthetic resin.

The upper body 60U of the connector housing 60 has a leading portion 61 for leading the external connection portion 25 out of the connector housing 60. The leading portion 61 contains a lance 63. This lance 63 is fit in and engaged with the latch hole 25B of the external connection portion 25, so that the electrical contact member 20 is engaged with the connector housing 60.

The lower body 60L of the connector housing 60 has an opening 65 that permits entry of the mating terminal 80. The opening 65 is provided in a position where the canted coil spring 50 of the accommodated terminal fitting 10 is disposed. The canted coil spring 50 can be exposed downward through the opening 65, and the entry of an engaging portion 89, which will be described below, is permitted.

The lower body 60L of the connector housing 60 has a placement surface 67, extending in the front-back direction, on which the reception portion 23 of the electrical contact member 20 is placed. The placement surface 67 is provided on the front and back of the opening 65 and the electrical contact member 20 is sandwiched between the placement surface 67 and the upper body 60U, thereby fixing the electrical contact member 20.

As shown in FIG. 1, the mating connector 85 includes the mating terminal 80 and a mating housing 87. The mating terminal 80 is composed of a conductive metal and is formed into a substantially L shape by bending a plate member extending in the up-and-down direction forward substantially at right angles. The upper surface of the mating terminal 80 at the end facing the electrical contact member 20 defines a contact surface 81.

The mating terminal 80 is held in the mating housing 87 by insert molding. The contact surface 81 is held by the engaging portion 89. The connector 15 and the mating connector 85 are engaged with each other when the engaging portion 89 enters the opening 65. The distance between the facing surface 21 of the electrical contact member 20 and the contact surface 81 of the mating terminal 80 in engagement is predetermined to enable use in the non-linear region of the canted coil spring 50 in the state where the connector 15 and the mating connector 85 are engaged completely with each other.

The advantageous effects of the terminal fitting 10 and the connector 15 according to this embodiment, which have the aforementioned configurations, will now be explained.

Before the mating terminal 80 is in contact with the canted coil spring 50, as shown in FIGS. 1 and 2, the canted coil spring 50 is held with the coil axis L positioned at a level lower than that of the center axis of the holder shaft 40 due to its own weight, and with the outer periphery of the holder shaft 40 in contact with the inner periphery of the canted coil spring 50. In addition, the center axis of the holder shaft 40 is substantially parallel with the facing surface 21. Thus, the canted coil spring 50 is held by the holder shaft 40 in such a manner that the coil axis L of the canted coil spring 50 is substantially parallel with the facing surface 21 of the electrical contact member 20.

The terminal fitting 10 is contained in the connector housing 60. The latch hole 25B of the electrical contact member 20 is engaged with the lance 63 and the front and back end portions of the reception portion 23 are sandwiched between the placement surface 67 and the upper body 60U. Thus, the terminal fitting 10 is fixed in the connector housing 60. Further, the surface of the terminal fitting 10 except the opening 65 is covered and protected by the connector housing 60.

Figure 5:
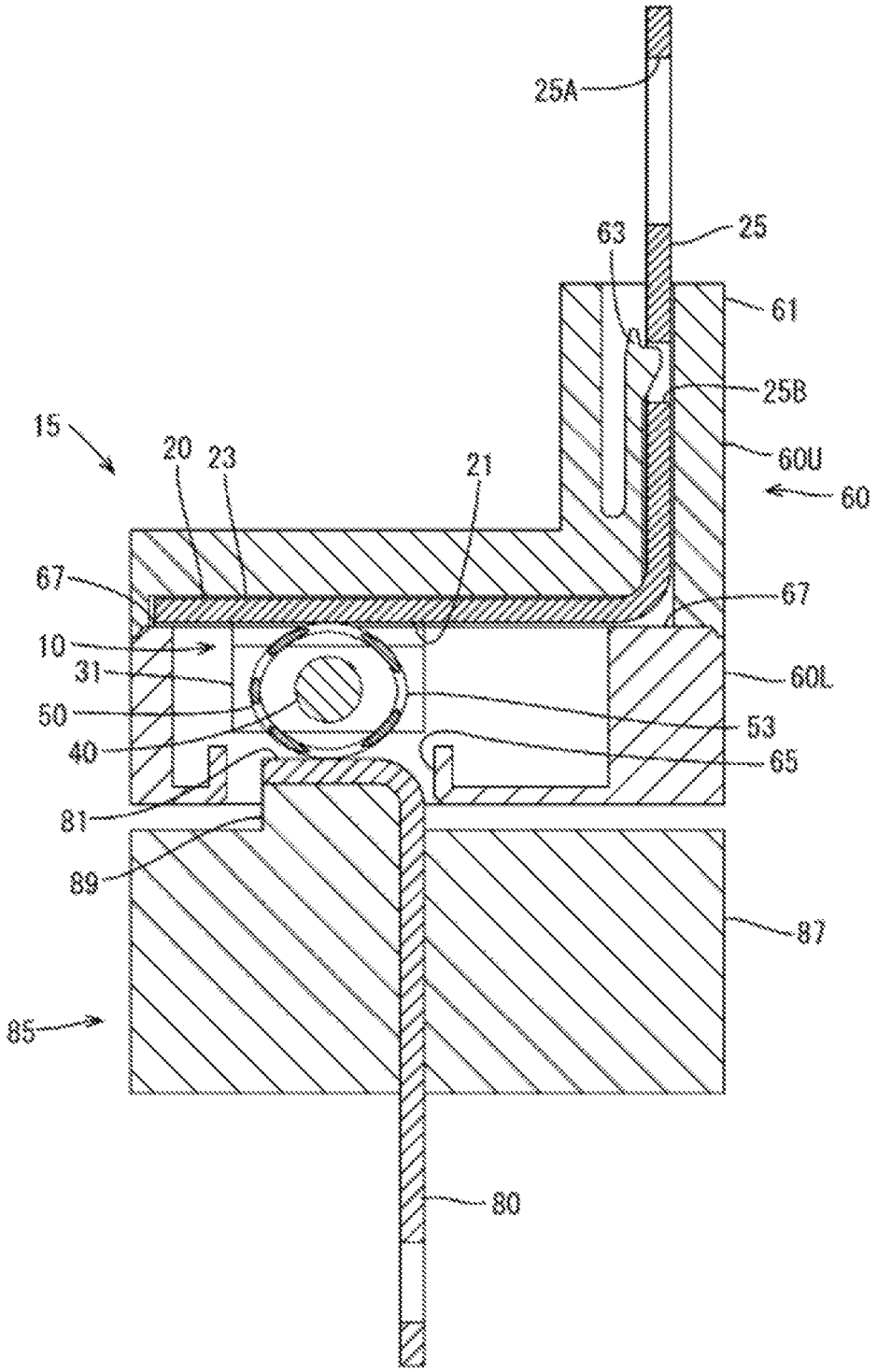
FIG. 5 is a sectional view showing the state where the connector and the mating connector are close to each other.

In addition, as shown in FIG. 5, if the relative distance between the connector 15 and the mating connector 85 is shortened, the contact surface 81 of the mating terminal 80 comes in contact with the outer region 53 of the canted coil spring 50, so that the canted coil spring 50 is pushed up and the outer region 53 of the canted coil spring 50 comes in contact with the facing surface 21 of the electrical contact member 20. In this state, the canted coil spring 50 with its minor axis oriented in the up-and-down direction is sandwiched between the contact surface 81 of the mating terminal 80 and the facing surface 21 of the electrical contact member 20, thereby establishing electrical connection between the mating terminal 80 and the electrical contact member 20. At this time, the electrical contact member 20 and the mating terminal 80 are in contact with the canted coil spring 50 at multiple points, thereby securing many junctions and reducing contact resistance.

Figure 6:
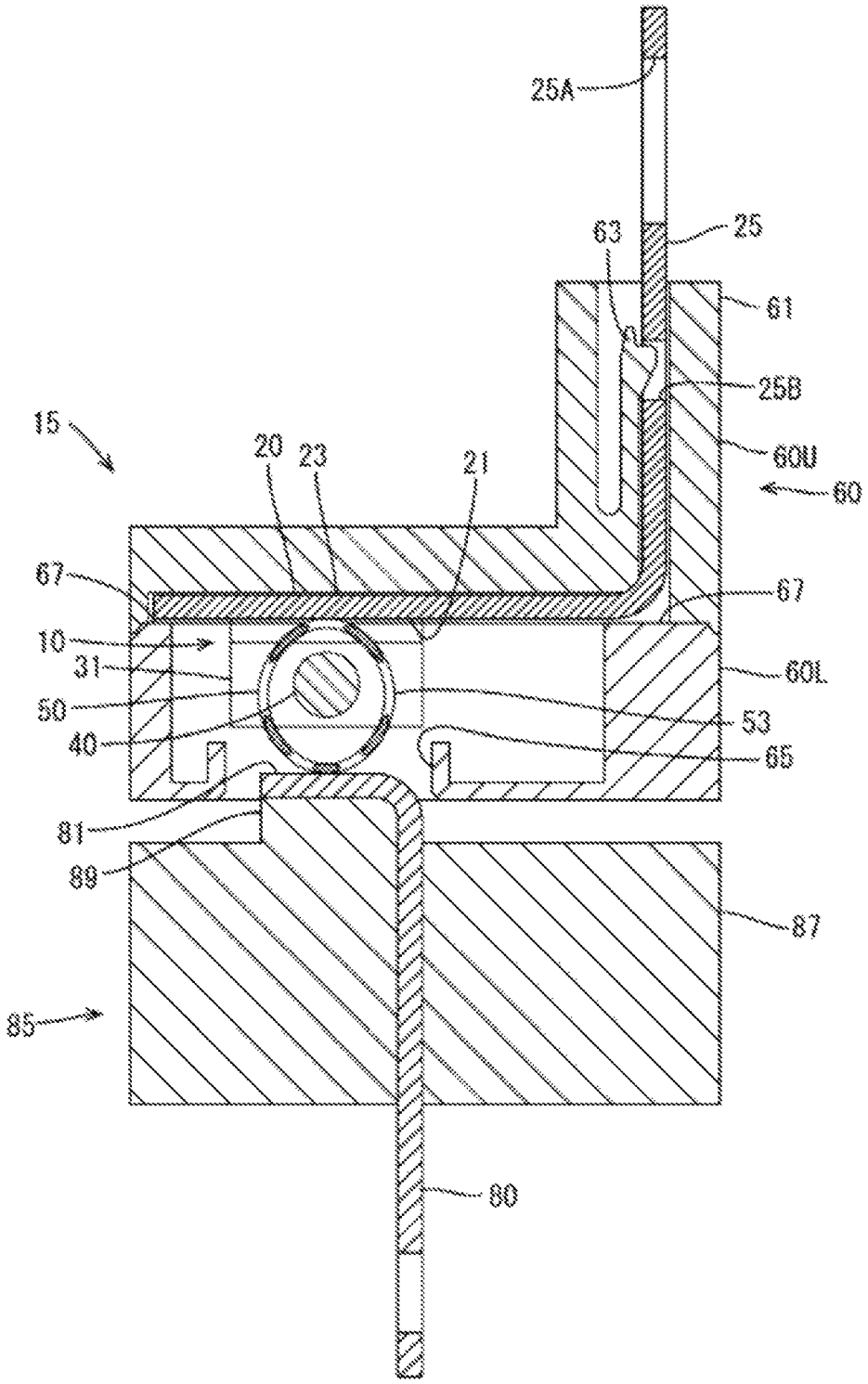
FIG. 6 is a sectional view showing the state where the connector and the mating connector are close to each other.

Before the mating terminal 80 is in contact with the canted coil spring 50, the canted coil spring 50 may be held by the holder shaft 40 with the major axis of the canted coil spring 50 oriented in the up-and-down direction. In this case, as shown in FIG. 6, if the relative distance between the connector 15 and the mating connector 85 is shortened, the contact surface 81 of the mating terminal 80 comes in contact with the outer region 53 of the canted coil spring 50, so that the canted coil spring 50 is pushed up toward the electrical contact member 20. Subsequently, with the major axis of the canted coil spring 50 oriented in the up-and-down direction, the outer region 53 of the canted coil spring 50 comes in contact with the facing surface 21 of the electrical contact member 20. In this state, if a further pressing force from the mating terminal 80 is applied to the canted coil spring 50, to release the force, the canted coil spring 50 rotates in such a manner that its minor axis is oriented in the up-and-down direction and settles in the state shown in FIG. 5.

Figure 3:
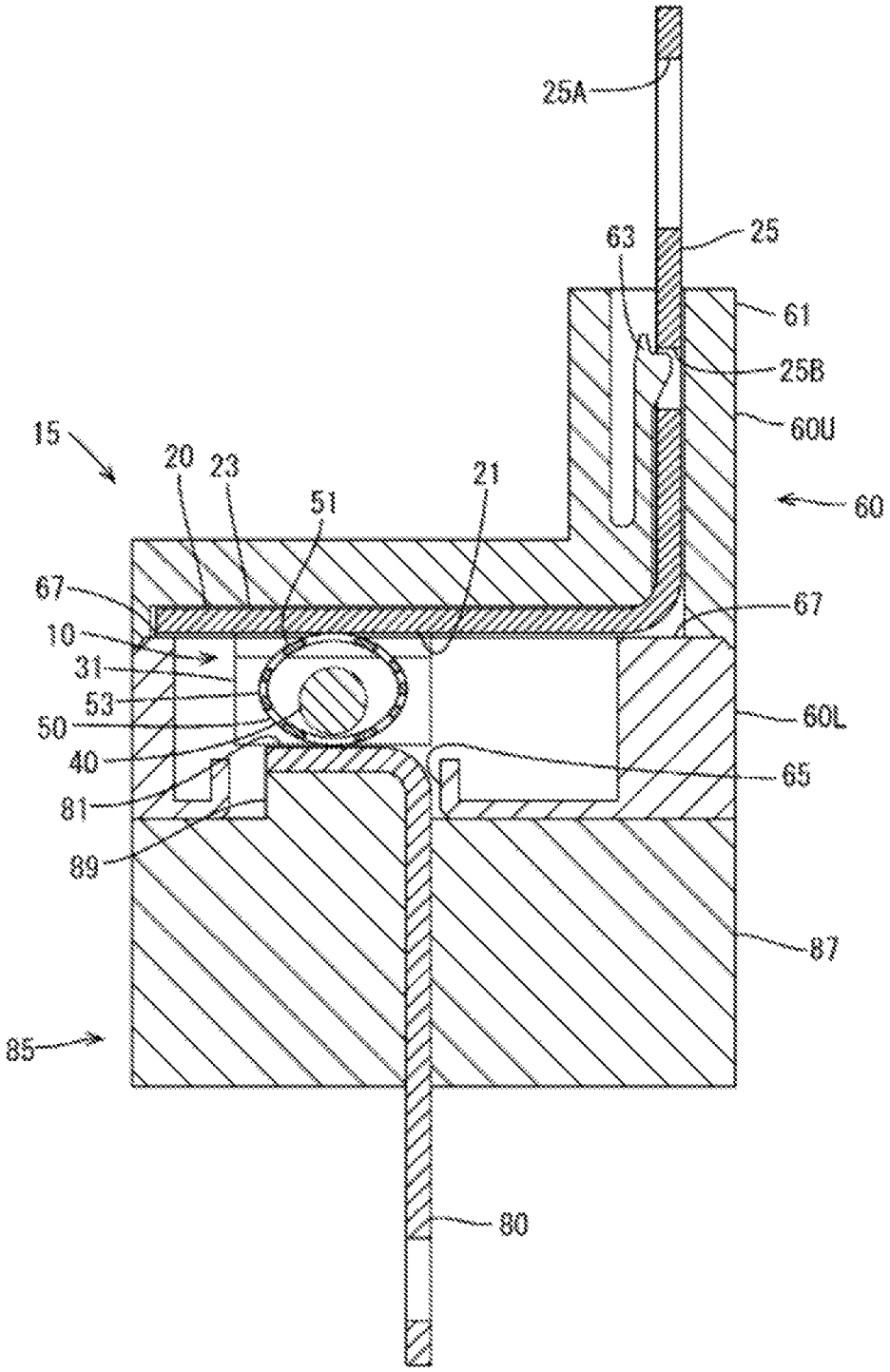
FIG. 3 is a sectional view showing the state where the connector and the mating connector are completely engaged with each other.

In the connection state shown in FIG. 5, if the relative distance between the connector 15 and the mating connector 85 is shortened farther such that the mating terminal 80 and the electrical contact member 20 further approach each other, the pressing force from the mating terminal 80 is applied to the canted coil spring 50. Upon reception of such pressing force, as shown in FIGS. 3 and 4, the canted coil spring 50 resists its elasticity and deforms in such a manner that the wound surface is inclined farther toward the coil axis L. Through this process, in a contact portion between the canted coil spring 50 and the contact surface 81 of the mating terminal 80 and a contact portion between the canted coil spring 50 and the facing surface 21 of the electrical contact member 20, a shifted movement phenomenon occurs in such a manner that the canted coil spring rubs each surface. Therefore, any contamination on the surfaces 81 and 21 is rubbed off. It should be noted that the canted coil spring 50 is only held by the holder shaft 40 without being fixed at the end portions and the like. Thus, nothing prevents it from deforming.

In addition, as shown in FIGS. 3 and 4, in the state where the connector 15 and the mating connector 85 are engaged completely with each other, use in the non-linear region of the canted coil spring 50 is executed. Suppose now that the relative distance between the electrical contact member 20 and the mating terminal 80 changes due to vibration or the like, so that the pressing force of the mating terminal 80 is changed and the height of the canted coil spring 50 is changed. Even in this case, in the non-linear region, the spring load of the canted coil spring 50 does not significantly change depending on the height, and the spring load on the electrical contact member 20 and the mating terminal 80 does not change. Accordingly, even if the mating terminal 80 is moved by vibration or the like, influence on the contact resistance resulting from the movement of the mating terminal 80 can be suppressed. The canted coil spring 50 has a function of ensuring contact pressure and establishing continuity in this manner, resulting in reductions in parts count and size.

As described above, in the terminal fitting 10 of this embodiment, the canted coil spring 50 fixed to the electrical contact member 20 through the holder shaft 40 is disposed in such a manner that the coil axis L is parallel with the facing surface 21 of the electrical contact member 20 and the wound surface is inclined with respect to the coil axis L. Accordingly, when further receiving pressing force resulting from the approaching mating terminal 80, the canted coil spring 50 resists its elasticity and deforms in such a manner that the wound surface is inclined more. Through this process, a shifted movement phenomenon occurs in such a manner that the canted coil spring 50 rubs the facing surface 21 and the contact surface 81. Therefore, any contamination that may be present on the surfaces 21 and 81 is rubbed off. Further, the canted coil spring 50 has a function of ensuring contact pressure and establishing continuity in this manner, resulting in reductions in parts count and size.

The invention is not limited to the embodiment described above and shown in the drawings and include those in various modes below.

Although in the aforementioned embodiment both end portions of the holder shaft 40 are passed through the fixed holes 33 of the fixed segments 31 and then swaged for fixing, the holder shaft may be fixed, for example, by welding a lanced piece or the like. In addition, it is acceptable that not both end portions but only one end is fixed and the other end is provided with a structure for preventing it from dropping out (e.g., pushing it against a plate piece or increasing the diameter of the holder shaft).

Although in the aforementioned embodiment the coil axis L of the canted coil spring 50 is oriented in such a manner that it extends in the left-right direction, it may be oriented in such a manner that the coil axis L extends in the front-back direction of the electrical contact member 20.

Although in the aforementioned embodiment the external connection portion 25 is led out of the connector housing 60 and thus connected to the external circuit, the wire connected to the external circuit may be connected to the electrical contact member, thereby establishing connection to the external circuit.

Although in the aforementioned embodiment the holder shaft 40 is composed of brass, it may be composed of SUS, for example. Further, although the holder shaft 40 is supposed to be a round bar, it may instead be a flat plate, cornered bar, or elliptic bar.

REFERENCE SIGNS LIST

10 . . . terminal fitting
15 . . . connector
20 . . . electrical contact member
21 . . . facing surface
23 . . . reception portion
25 . . . external connection portion
31 . . . fixed segment

33 . . . fixed hole
40 . . . holder shaft
50 . . . canted coil spring
51 . . . conductive wire material
55 . . . both end portions
60 . . . connector housing
60U . . . upper body
60L . . . lower body
65 . . . opening
80 . . . mating terminal
81 . . . contact surface
85 . . . mating connector
89 . . . engaging portion
L . . . coil axis

The invention claimed is:

1. A terminal fitting comprising:

an electrical contact member that has a facing surface configured to face a contact surface of a mating terminal, the electrical contact member being configured to be connected to an external circuit;

a canted coil spring formed from a conductive wire formed to define a coil of multiple turns and having a wound surface inclined with respect to a coil axis of the canted coil spring and, in a natural state, having an elliptic shape when viewed along the coil axis, the coil axis being parallel with the facing surface of the electrical contact member, the canted coil spring being sandwiched between the mating terminal and the electrical contact member when the mating terminal and the electrical contact member approach each other; and a holder shaft provided to the electrical contact member and inserted in the canted coil spring to hold the canted coil spring in a posture where the coil axis is parallel with the facing surface of the electrical contact member, wherein the electrical contact member includes two fixed segments facing each other and standing from respective end portions of the facing surface, and opposite end portions of the holder shaft are fixed to the fixed segments, and when the electrical contact member and the mating terminal approach each other, the canted coil spring is sandwiched between the electrical contact member and the mating terminal, the canted coil spring is crushed in a direction of a minor axis of the elliptic shape and is inclined further toward the coil axis.

2. A connector comprising a connector housing that can accommodate the terminal fitting according to claim 1, the connector housing has an opening through which the mating terminal is capable of entering into the connector housing and coming in contact with the canted coil spring.

3. The connector of claim 2, wherein the holder shaft has a diameter smaller than a diameter defined by the minor axis of the canted coil spring.

4. The connector of claim 3, wherein the holder shaft is offset from the coil axis in a direction away from the opening in the connector housing prior to connection of the mating terminal and the terminal fitting and wherein the mating terminal pushes the canted coil spring into contact with a side of the holder shaft facing the opening.

5. The connector of claim 3 wherein the fixed segments are bent from opposite end positions of the reception portion.

6. The terminal fitting claim 1, wherein the holder shaft has a diameter smaller than a diameter defined by the minor axis of the canted coil spring.

7. The terminal fitting of claim 1, wherein the fixed segments being bent from opposite end positions of the reception portion.

* * * * *